US009466400B2

(12) United States Patent
Singh et al.

(10) Patent No.: US 9,466,400 B2
(45) Date of Patent: Oct. 11, 2016

(54) VENTILATED TRANSFER CASK WITH LIFTING FEATURE

(71) Applicant: Holtec International, Marlton, NJ (US)

(72) Inventors: Krishna P. Singh, Hobe Sound, FL (US); John D. Griffiths, Deptford, NJ (US)

(73) Assignee: HOLTEC INTERNATIONAL

( * ) Notice: Subject to any disclaimer, the term of this patent is extended or adjusted under 35 U.S.C. 154(b) by 0 days.

(21) Appl. No.: 14/762,874

(22) PCT Filed: Jan. 27, 2014

(86) PCT No.: PCT/US2014/013185

§ 371 (c)(1),
(2) Date: Jul. 23, 2015

(87) PCT Pub. No.: WO2014/117082

PCT Pub. Date: Jul. 31, 2014

(65) Prior Publication Data

US 2016/0005501 A1 Jan. 7, 2016

Related U.S. Application Data

(60) Provisional application No. 61/756,787, filed on Jan. 25, 2013, provisional application No. 61/902,559, filed on Nov. 11, 2013.

(51) Int. Cl.

| | |
|---|---|
| ***G21F 5/10*** | (2006.01) |
| ***G21F 5/008*** | (2006.01) |
| ***G21F 5/08*** | (2006.01) |
| ***G21F 5/14*** | (2006.01) |

(52) U.S. Cl.

CPC ..... *G21F 5/10* (2013.01); *G21F 5/008* (2013.01); *G21F 5/08* (2013.01); *G21F 5/14* (2013.01)

(58) Field of Classification Search

CPC ..... G21F 5/008; G21F 5/08; G21F 5/10; G21F 5/14

See application file for complete search history.

(56) References Cited

U.S. PATENT DOCUMENTS

| | | | | |
|---|---|---|---|---|
| 4,423,802 | A * | 1/1984 | Botzem | G21F 5/08 188/377 |
| 5,546,436 | A * | 8/1996 | Jones | G21F 5/008 376/272 |
| 6,587,536 | B1 | 7/2003 | Singh et al. | |
| 7,330,525 | B2 | 2/2008 | Singh et al. | |

(Continued)

OTHER PUBLICATIONS

Corresponding International Search Report and Written Opinion for PCT/US14/13185 dated May 14, 2014.

*Primary Examiner* — Wyatt Stoffa
(74) *Attorney, Agent, or Firm* — The Belles Group, P.C.

(57) ABSTRACT

An apparatus for transferring spent nuclear fuel in the form of a cask having a cylindrical inner shell forming a cavity configured to receive a canister containing spent nuclear fuel, an intermediate shell disposed concentrically around and spaced apart from the inner shell and an outer shell disposed concentrically around and spaced apart from the intermediate shell. A bottom flange is affixed to bottoms of each of the shells, and a bottom lid is removably affixed to the bottom flange. A top flange is affixed to tops of each of the shells, and a top lid is seated on the top flange. An annulus for air flow may be formed between the inner shell and the canister; the bottom lid may include an impact zone including impact absorbing structure; and the top flange may have integrally formed trunnions.

20 Claims, 7 Drawing Sheets

(56) References Cited

U.S. PATENT DOCUMENTS

2003/0004390 A1* 1/2003 Matsunaga ..... G21F 5/12 588/252
2003/0147486 A1* 8/2003 Singh ..... G21C 19/06 376/272
2003/0194042 A1* 10/2003 Singh ..... G21C 19/32 376/261
2004/0071254 A1* 4/2004 Malalel ..... G21F 5/08 376/272
2005/0173432 A1* 8/2005 Chanzy ..... G21F 5/08 220/62.22
2005/0224729 A1* 10/2005 Tamaki ..... G21F 5/00 250/507.1
2006/0215803 A1* 9/2006 Singh ..... G21F 5/002 376/272
2009/0069621 A1* 3/2009 Singh ..... G21F 5/005 588/16
2010/0284506 A1* 11/2010 Singh ..... G21F 5/005 376/272
2011/0172484 A1* 7/2011 Singh ..... G21F 5/06 588/16
2011/0239683 A1 10/2011 Czamara et al.
2012/0142991 A1* 6/2012 Singh ..... G21F 5/005 588/16
2013/0068578 A1* 3/2013 Saito ..... G21F 9/36 188/377
2014/0192946 A1* 7/2014 Singh ..... G21F 5/008 376/272
2014/0341330 A1* 11/2014 Singh ..... G21F 5/005 376/272

* cited by examiner

VENTILATED TRANSFER CASK WITH LIFTING FEATURE

CROSS REFERENCE TO RELATED APPLICATIONS

Priority is claimed as a national stage application, under 35 U.S.C. §371, to international patent application No. PCT/US2014/013185, filed Jan. 27, 2014, which claims priority to U.S. provisional application No. 61/756,787, filed Jan. 25, 2013, and to U.S. provisional application No. 61/902,559, filed Nov. 11, 2013. The disclosures of the aforementioned priority documents are incorporated herein by reference in their entirety.

FIELD OF THE INVENTION

The field of the present invention relates to casks for transferring spent nuclear fuel out of a pool.

BACKGROUND OF THE INVENTION

In the operation of nuclear reactors, it is customary to remove fuel assemblies after their energy has been depleted down to a predetermined level. In the commercial nuclear industry, fuel assemblies are typically an assemblage of long, hollow, zircaloy tubes filled with enriched uranium. Upon depletion and subsequent removal, spent nuclear fuel is still highly radioactive and produces considerable heat, requiring that great care be taken in its packaging, transporting, and storing. Specifically, spent nuclear fuel emits extremely dangerous neutrons and gamma photons. It is imperative that these neutrons and gamma photons be contained at all times.

Upon defueling a nuclear reactor, spent nuclear fuel is placed in a canister that is submerged in a storage pool. The storage pool facilitates cooling of the spent nuclear fuel and provides radiation shielding that helps contain the emitted neutrons and gamma photons. Generally, canisters are cylindrical steel containers with flat bottoms. A typical canister can hold approximately 24 PWR fuel assemblies or 60 BWR fuel assemblies. When fully loaded with spent nuclear fuel, a canister weighs approximately 45 tons. However, a canister alone does not provide adequate containment of the neutrons and gamma photons emitted by the spent nuclear fuel contained therein. As such, a loaded canister cannot be further transported from the storage pool without some additional radiation shielding. Because it is preferable to store spent nuclear fuel in is "dry state," the canister must eventually be removed from the storage pool. As such, the canisters need additional radiation shielding during transport and long-term dry storage of the spent nuclear fuel.

In state of the art facilities, additional radiation shielding is achieved by placing the loaded canisters in large cylindrical containers called casks. There are two types of casks used in the industry, storage casks and transfer casks. A transfer cask is used to transport, canisters of spent nuclear fuel from location to location while a storage cask is used to store spent nuclear fuel in the "dry state" for long periods of time. Both transfer casks and storage casks are designed to shield the environment from the neutron and gamma radiation emitted by the spent nuclear fuel through the use of two principles.

First, the gamma radiation emitted by spent nuclear fuel is blocked by placing mass in its way, the greater the density and thickness of the blocking mass, the more effective the attenuation of the gamma radiation. Examples of effective gamma absorbing materials are concrete, lead, and steel. Second, the neutrons emitted by spent nuclear fuel are blocked by placing a neutron absorbing material in their path. Any material rich in hydrogen serves as an effective neutron shield. One such example of an effective neutron absorbing material is water. Other types of material may also serve as an effective neutron shield, such as aluminum trihydrate mixed with boron carbide in an epoxy resin.

Guided by the above principles, storage casks are designed to be large, heavy structures made of steel, lead, concrete and an environmentally suitable hydrogenous material. However, because the focus in designing a storage cask is to provide adequate radiation shielding for the long-term storage of spent nuclear fuel, size and weight are often secondary considerations (if considered at all). As a result of maximizing the thickness of the gamma and neutron absorbing materials, the weight and size of storage casks often cause problems associated with lifting and handling. Typically, storage casks weigh approximately 150 tons and have a height greater than 15 ft. A common problem is that storage casks are often too heavy for the capacity of most nuclear power plant cranes and as such cannot be lifted. Another common problem is that storage casks are too large to be placed in storage pools. Thus, in order to store spent nuclear fuel in a storage cask, a loaded canister must be removed from the storage pool, prepared in a staging area, and transported to the storage cask. Additional radiation shielding is needed throughout all stages of this procedure.

Removal from the storage pool and transport of the loaded canister to the storage cask is facilitated by a transfer cask. In facilities utilizing transfer casks to transport loaded canisters, an empty canister is placed into an open transfer cask. The canister and transfer cask are then submerged in the storage pool. As each assembly of spent nuclear fuel is depleted, it is removed from the reactor and lowered into the storage pool and placed in the submerged canister (which is within the transfer cask). The loaded canister is then fitted with its lid, enclosing the spent nuclear fuel and water from the pool within. The enclosed water provides neutron radiation shielding for the spent nuclear fuel once the transfer cask is removed from the pool. The canister and transfer cask are then removed from the pool by a crane and set down in a staging area to prepare the spent nuclear fuel for storage in the "dry state." Once in the staging area, the water contained in the canister is pumped out of the canister. This is called dewatering. Once dewatered, the spent nuclear fuel is allowed to dry. Once dry, the canister is back-filled with an inert gas such as helium. The canister is then sealed and the canister and the transfer cask are once again lifted by the plant's crane and transported to the storage cask. The transfer cask is placed atop the storage cask and the canister is lowered through a bottom opening in the transfer cask into the storage cask.

Because a transfer cask must be lifted and handled by a plant's crane (or other equipment), transfer casks are designed to be a smaller and lighter than storage casks. A transfer cask must be small enough to fit in a storage pool and light enough so that, when it is loaded with a canister of spent nuclear fuel, its weight does not exceed the crane's rated weight limit. Additionally, a transfer cask must still perform the important function of providing adequate radiation shielding for both the neutron and gamma radiation emitted by the enclosed spent nuclear fuel. As such, transfer casks are made of a gamma absorbing material such as lead and contain a neutron absorbing material. While the pool water sealed in the canister does provide some neutron shielding, this water is eventually drained at the staging area. As such, many transfer casks have either a separate layer of neutron absorbing material or have an annulus filled with water that surrounds the cavity of the transfer cask in which the loaded canister is located.

The allowable weight of a transfer cask is limited by the lifting capacity of the plant's crane (or other lifting equipment). The load handled by the crane includes not only the weight of the transfer cask itself, but also the weight of the transfer casks payload (i.e., the canister and its contents). A transfer cask must be designed so that the total load handled by the crane during all handling evolutions does not exceed the crane's rated weight limit, which is typically in the range of 100 125 tons. As such, the permissible weight of a transfer cask is equal to the rated capacity of the plant crane less the weight of its payload. Moreover, when the combined weight of a transfer cask and its payload is equal to the rated lifting capacity of the plant crane, the possible radiation shielding that can be provided by a transfer cask is at a maximum for that particular payload.

Because the weight of the transfer cask's payload varies during the different stages of the transport procedure, the permissible weight of the transfer cask is equal to the rated capacity of the plant crane less the weight of the transfer cask's maximum payload at any lifting step. The weight of the transfer cask's payload is at a maximum when the transfer cask and canister are lifted out of the storage pool, at which time the canister is full of spent nuclear fuel and water. Thus, according to prior art methods, it is at this stage that the permissible weight of a transfer cask is calculated. The transfer cask is then constructed using this permissible weight as a design limitation.

The design limitations of the weight of the transfer cask have other implications. For example, in the present state-of-the-art, a small annulus is formed between the canister and the transfer cask cavity which is protected from contamination while in the pool by a seal and by employing a high integrity gasketed joint between the bottom lid and the cask body. When outside the pool, the annulus is typically filled and continually flushed with demineralized water, which provides an effective means to remove the decay heat generated by the canister and thus keep its fuel cladding temperature within regulatory limits. The circulating water annulus cooling system utilizes flowing water in a closed loop as the medium to extract heat from the wall of the canister. The heated water, in turn, is cooled by an air cooler or some other heat exchanger. However, the heat transmission capability provided by the water in the annulus between the canister and the cask is inconvenient and cumbersome to maintain when the cask has to be transported on the haul path on its way to the storage facility.

Other features of the transfer cask that do not directly pertain to radiation shielding may be compromised or entirely neglected so that the permissible weight of the transfer cask, when loaded with the payload, is no more than the rated capacity of the plant crane.

SUMMARY OF THE INVENTION

The present invention is directed toward a transfer cask for transporting canisters of spent nuclear fuel from location to location, particularly between a pool and a staging are in which the canister can be moved into a storage cask. The transfer cask may have one or more features, described in detail below, which provide advantages during this transfer process. The transfer cask may be ventilated to aid in cooling of the canister; it may include in impact zone for reducing damage that may be caused accidents during transfer; and it may include trunnions integrally formed into an upper flange to provide stronger lifting points for the transfer cask.

In a first separate aspect of the present invention, an apparatus for transferring spent nuclear fuel includes a cylindrical inner shell forming a cavity configured to receive a canister containing spent nuclear fuel, an intermediate shell disposed concentrically around and spaced apart from the inner shell, and an outer shell disposed concentrically around and spaced apart from the intermediate shell. The cavity is configured so that an annulus is formed between a canister placed in the cavity and an inner wall of the cylindrical inner shell. A bottom flange is affixed to bottoms of each of the shells, and a bottom lid is removably affixed to the bottom flange. The bottom lid includes at least one first channel fluidically connecting the annulus to an exterior of the bottom lid, wherein the at least one first channel is configured to preclude a direct line of travel from within the cavity to the exterior of the bottom lid. A top flange is affixed to tops of each of the shells and includes at least one second channel fluidically connecting the first annulus to an exterior of the top flange, wherein the at least one second channel is configured to preclude a direct line of travel from within the cavity to the exterior of the top flange, and a top lid is removably affixed to the top flange.

In a second separate aspect of the present invention, an apparatus for transferring spent nuclear fuel includes a cylindrical inner shell forming a cavity configured to receive a canister containing spent nuclear fuel, an intermediate shell disposed concentrically around and spaced apart from the inner shell, and an outer shell disposed concentrically around and spaced apart from the intermediate shell. A bottom flange is affixed to bottoms of each of the shells, and a bottom lid is removably affixed to the bottom flange. A top flange is affixed to tops of each of the shells, and a top lid is removably affixed to the top flange. The top flange includes at least two integrally formed trunnions configured to enable hoisting of the apparatus.

In a third separate aspect of the present invention, an apparatus for transferring spent nuclear fuel includes a cylindrical inner shell forming a cavity configured to receive a canister containing, spent nuclear fuel, an intermediate shell disposed concentrically around and spaced apart from the inner shell, and an outer shell disposed concentrically around and spaced apart from the intermediate shell. A bottom flange is affixed to bottoms of each of the shells, and a bottom lid is removably affixed to the bottom flange. The bottom lid includes an impact zone comprising an impact absorbing structure. A top flange is affixed to tops of each of the shells, and a top lid is removably affixed to the top flange.

In a fourth separate aspect of the present invention, any of the foregoing aspects may be employed in combination.

Accordingly, an improved transfer cask for spent nuclear fuel is disclosed. Advantages of the improvements will be apparent from the drawings and the description of the preferred embodiment.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
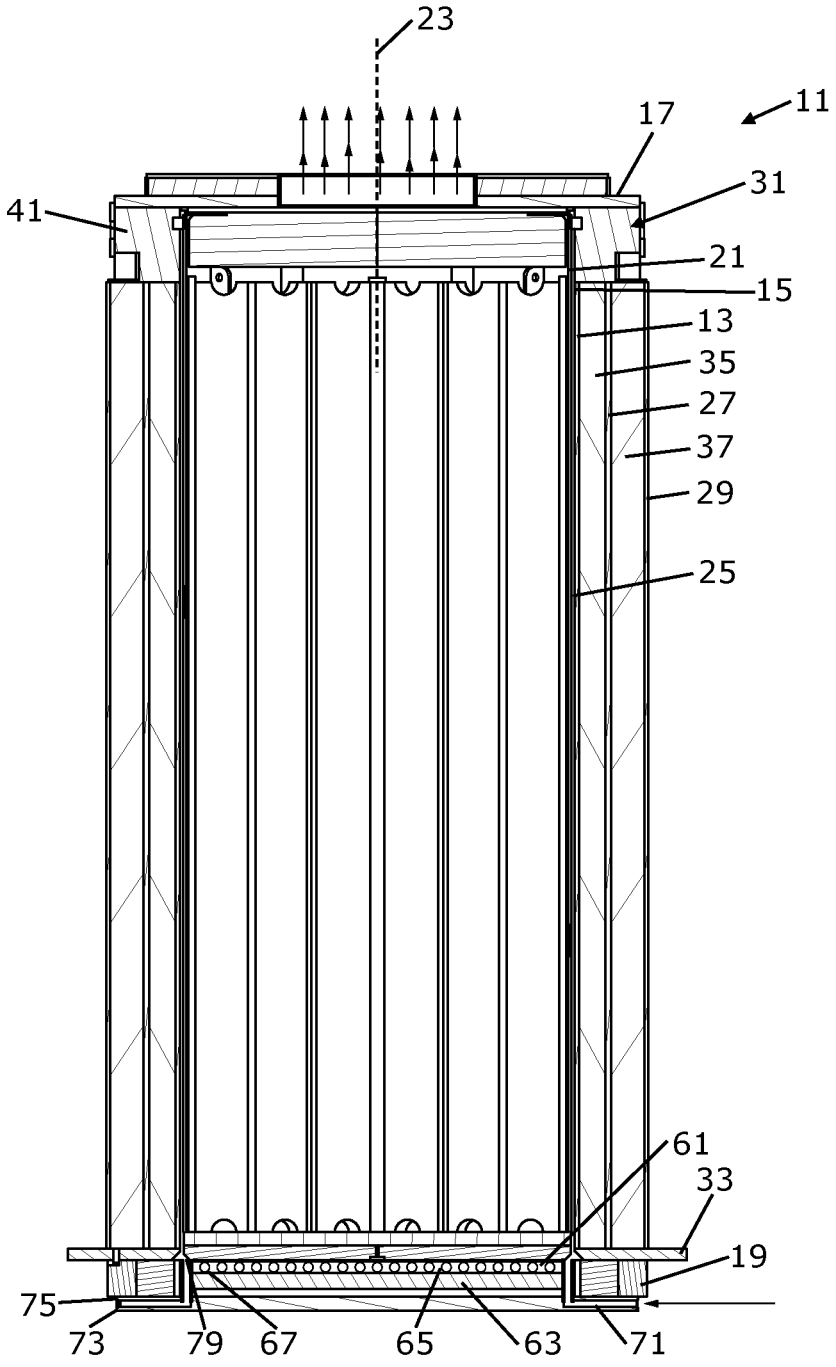
FIG. 1 is a cross-sectional view of a transfer cask.

The description of illustrative embodiments according to principles of the present invention is intended to be read in connection with the accompanying drawings, winch are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

FIG. 1 an apparatus for transferring spent nuclear fuel in the form of a transfer cask 11. The transfer cask 11 includes a cylindrical inner shell 13 which forms a cavity 15 along with the top lid 17 and the bottom lid 19. As shown, a canister 21 for holding spent nuclear fuel is disposed within the cavity 15. The inner shell 13 has a longitudinal axis 23, and the inner shell 13 has a slightly larger radius, measured from the longitudinal axis 23, as compared to the canister 21, to create an annulus 25 of space between the inner shell 13 and the canister 21 disposed in the cavity 15. This annulus 25, as discussed in greater detail below, serves to enable cooling of the canister 21 by ventilation with atmosphere.

The transfer cask further includes an intermediate shell 27 and an outer shell 29. Each of the inner shell 13, the intermediate shell 27, and the outer shell 29 are preferably made from carbon steel, with the top of each welded to a top flange 31, and the bottom of each welded to a bottom flange 33. The intermediate shell 27 is disposed concentrically around and spaced apart from the inner shell 13, thereby forming a second annulus 35. This second annulus 35 is capable of holding a gamma absorbing material such as concrete, lead, or steel. Lead is preferred because it most effectively provides gamma shielding for the radioactive spent nuclear fuel once it is placed within cavity 15. The outer shell 29 is disposed concentrically around and spaced apart from the intermediate shell 27, thereby forming a third annulus 37. This third annulus 37 is capable of holding a neutron absorbing material such as water or the aforementioned aluminum trihydrate-boron carbide-epoxy mixture. As shown, the third annulus 37 includes panels of a metal matrix composite. For alternative embodiments in which water is to be used in the third annulus, U.S. Pat. No. 7,330,525 describes a manner in which the outer shell may be formed, in order to contain water, and a process for using water as a neutron absorber in the transfer cask daring transfer of a canister containing spent nuclear fuel.

The top lid 17 is securable to the top flange 31 by extending bolts (not shown) through the top lid 17 to engage the top flange 31. The top lid 17 is typically only secured to the top flange 31 once the canister 21 is in place within the cavity 15 during the transfer process. A central opening 39 in the top lid 17 provides access to the canister 21 for performing certain handling operations with respect to the canister 21 while the top lid 17 is secured to top flange 31.

Figure 2B:
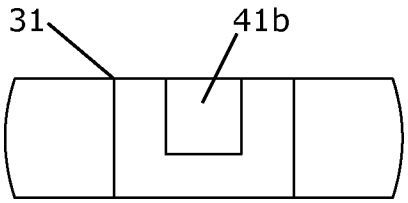
FIG. 2B is a schematic view of a first alternative trunnion configuration.
Figure 2C:
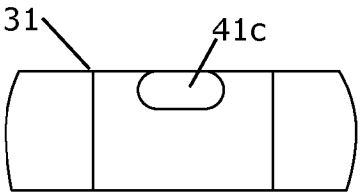
FIG. 2C is a schematic view of a second alternative trunnion configuration.
Figure 2A:
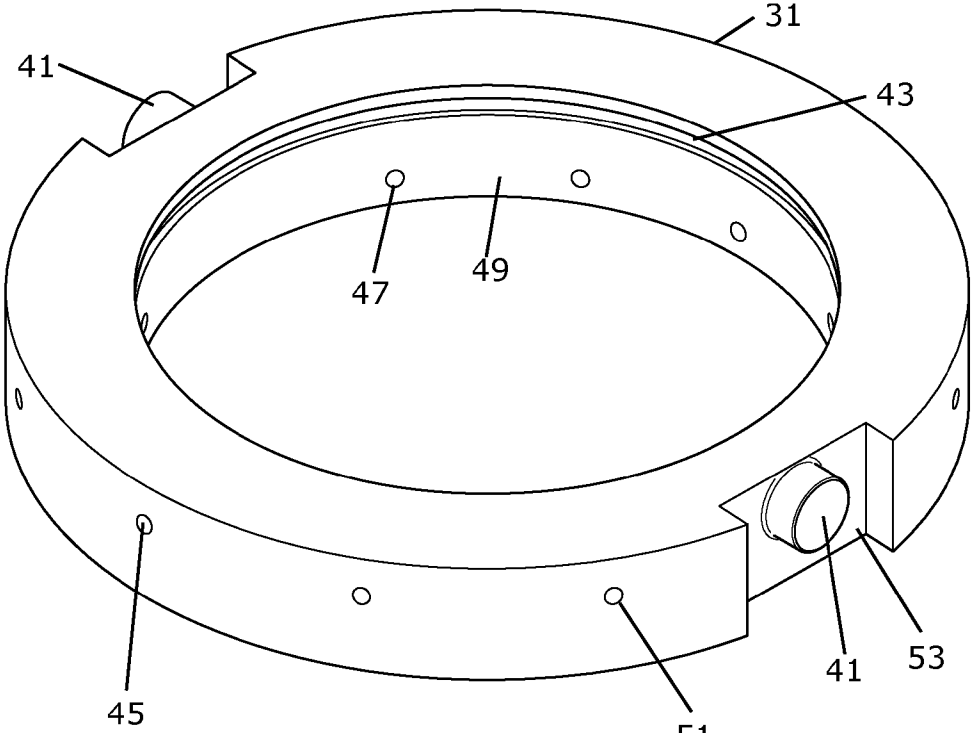
FIG. 2A is a perspective view of a top flange for a transfer cask.

Referring to FIG. 2A, the top flange 31 is integrally formed through forging and machining so that it does not include any joints, welds, or seams, and so that it does not include parts that are separately formed and then subsequently joined together. The top flange 31 is machined to include two trunnions 41 to be used for lifting the transfer cask with a crane. As shown in FIGS. 2A-C, the trunnions may be of a variety of cross sections such as round trunnions 41 (FIG. 2A), rectangular trunnions 41*b* (FIG. 2B), obround trunnions 41*c* (FIG. 2C), oblong trunnions, and the like. The cross-sectional form of the trunnions may be any shape according to design choice, with specific implementations limited only by the equipment used to hoist the transfer cask.

More than two trunnions may be machined as part of the top flange, based upon design choices and the lifting system with which the transfer cask is to be used. For purposes of stability during lifting, the trunnions are distributed approximately equidistantly around the top flange.

The top flange 31 also includes a seating groove 4 for a sealing ring not shown), which serves as a seal, against the canister and within the annulus, when the canister is placed in the cavity. A plurality of ventilation channels 45 are included in the top flange 31, with internal channel inlets 47 on the interior surface 49 of the top flange 31 located below the seating 43 so that when a canister is placed, air is directed through the ventilation channels 45. The ventilation channels 45 open up to the exterior of the top flange 31, and to the exterior of the transfer cask, at external channel outlets 51 so that the ventilation channels fluidically connect the annulus 25 with the exterior of the top flange 31 and the transfer cask. The ventilation channels 45 through the top flange 31 may have a variety of forms or paths, however, because an is being used to ventilate the transfer cask, and unlike water, air is not a good neutron absorber, the one design constraint for the ventilation channels is that the paths of the ventilation channels preclude a direct line of travel from within the cavity to the exterior of the top flange. With this design constraint, on the ventilation channels of the top flange, emissions from the canister cannot pass through an all-air pathway from the canister to the exterior of the transfer cask.

The integral design of the trunnions 41 as part of the top flange 31 serves to eliminate joints between the top flange and the trunnions, thereby significantly improving the fidelity of structural integrity of the overall lifting system (as compared to the prior art, in which the trunnions are joined to the top flange by welding or a threaded joint). The top flange 31 is also enlarged as compared to top flanges of the prior art, but still keeping within the constraints of the size of the cask pit in the pool and the lifting limit of the cask crane. Even though enlarged, the top flange 31, inclusive of the integral trunnions 41, has a smaller outer diameter as compared to the outer shell 29. To aid in preventing damage that may be caused by protruding trunnions in the event of a transfer cask accidentally tipping into other casks, each trunnion 41 is disposed within a recess 53 of the top flange 31. The larger top flange 31 also serves to provide increased shielding in the top region of the cask where most human activity (to weld and dry the canister) occurs.

Turning back to FIG. 1, the bottom lid 19 is secured to the bottom flange 33 by a plurality of bolts (not shown) that extend through holes in the bottom flange 33 the engage the bottom lid 19. The bottom lid 19 includes an impact zone 61 positioned directly beneath the cavity 15. The bottom lid 19 also includes a gamma-absorbing layer 63, such as lead, below the impact zone 61. To be most effective in absorbing impacts from accidental falls of the transfer cask, the impact zone 61 extends substantially under the entirety of the cavity 15. The impact zone includes an impact absorbing structure 65 which can serve to cushion the fall of a canister loaded into the transfer cask, thereby providing some damage protection to the fuel in the event of a handling mishap while the transfer cask is being moved around the building or plant site. As shown, the impact absorbing structure 65 is formed by a plurality of cylindrical tubes 67 within the bottom lid 19. These tubes 67 are distributed throughout the impact zone 61, with their longitudinal axes aligned with a major dimension (i.e., the diameter) of the bottom lid 19. The thickness, number of tubes, and the cross-sectional shape of the tubes are a matter of design choice based upon the particular implementation. Factors that may be taken into consideration for these design choices include estimated drop height (based on the operational procedures of the facility), the weight of the canister, and the weight of the loaded transfer cask.

Computations have shown that a set of parallel 2-inch tubes distributed throughout the impact zone 61 can limit the impact load experienced by a 40-ton canister, placed with a transfer cask, falling from 18 inches onto a concrete pad to a g-force of less than 25 (in the absence of the impact limiter, the g-force may shoot up to over 100).

A plurality of ventilation channels 71 are included in the bottom lid 29, with external channel inlets 73 on the external surface 75 of the bottom lid and internal channel outlets 77 located so that the ventilation channels 71 can direct an air flow into the annulus 25. A plurality of ventilation channels configured in this manner are formed approximately equidistantly around the bottom lid to provide cooling ventilation to the canister 21 outside of the storage pool. At the point of intersection between the channel outlets 77 and the annulus 25, the bottom flange 33 is configured with a chamfered surface 79 to broaden out the annulus 25, thereby providing an enlarged space about the base of the canister 21 into which air may be drawn through the ventilation channels 71. Each channel inlet 73 is configured to receive a sealing plug (not shown), which may threadably engage the channel inlet 73 to provide a seal and turn the ventilation channel and annulus into a "blind" cavity that does not have ingress through the bottom lid. Similar plugs may be placed in the channel outlets of the top flange, thereby rendering the entire annuls cavity into a "blind" cavity. Such plugs may be placed under circumstances where it is desirable to protect the ventilation channel from ingress of contaminated water or other matter, either solely at the bottom of the transfer cask, or at the top and the bottom.

Figure 5:
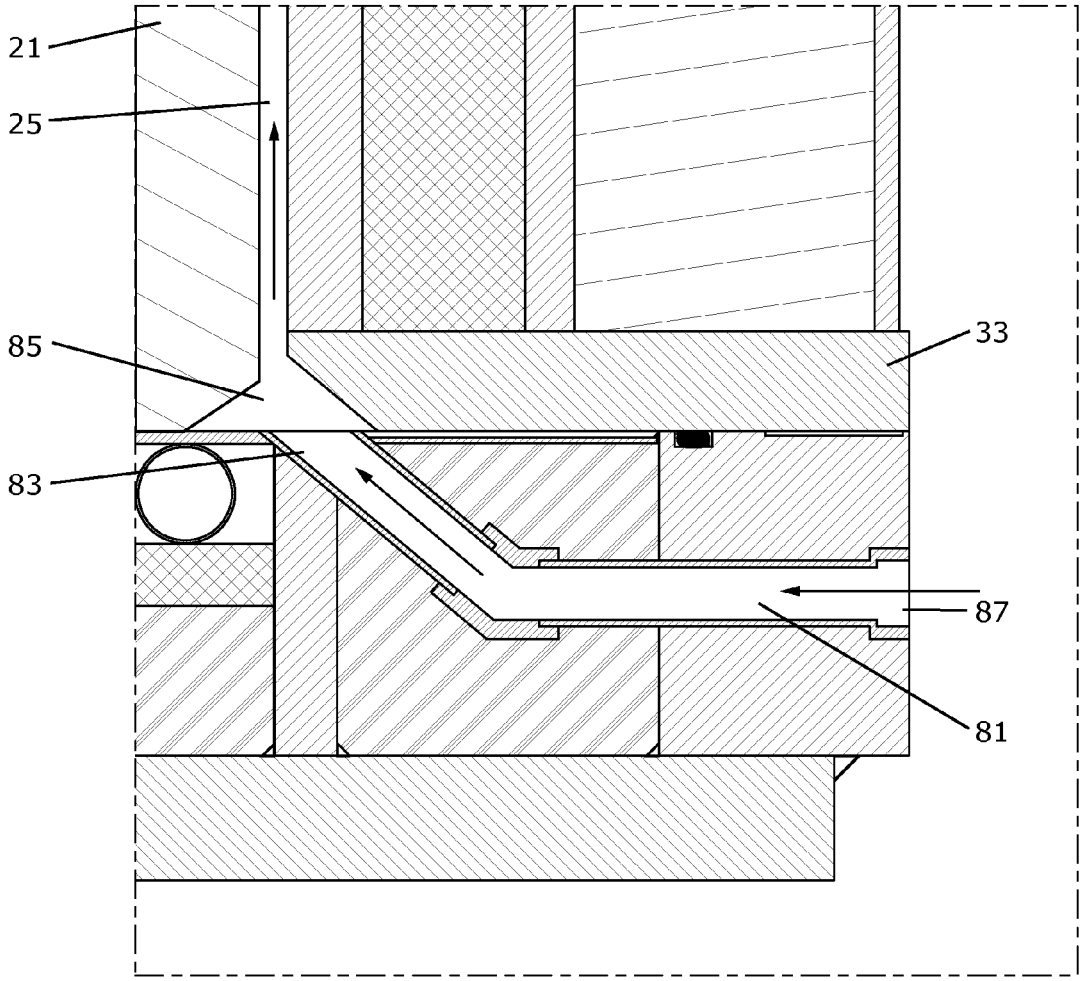
FIG. 5 is a partial sectional view of a bottom portion of a second alternative transfer cask.

A second example of a ventilation channel 81 is shown in FIG. 5, and a plurality of ventilation channels 81 configured in this manner are formed approximately equidistantly around the bottom lid to provide cooling ventilation to the canister 21 outside of the storage pool. Again, at the point of intersection between the channel outlets 83 and the annulus 25, an enlarged space 85 is included about the base of the canister 21 into which air may be drawn through the ventilation channels 81. The channel inlets 87 may also be configured to receive a sealing plug (not shown).

The ventilation channels 71 through the bottom lid 29 may have a variety of forms or paths, however, because air is being used to ventilate the transfer cask, and unlike water, air is not a good neutron absorber, the one design constraint for the ventilation channels is that the paths of the ventilation channels preclude a direct line of travel from within the cavity to the exterior of the bottom lid. With this design constraint on the ventilation channels of the bottom lid, emissions from the canister cannot pass through an all-air pathway from the canister to the exterior of the transfer cask.

Figure 3:
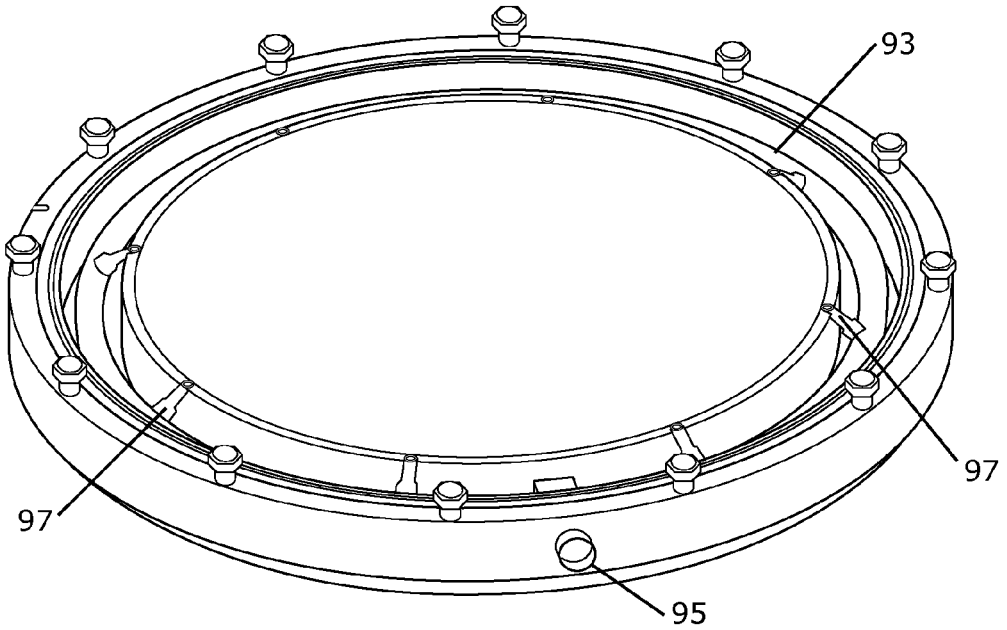
FIG. 3 is a perspective view of a bottom lid for a transfer cask.
Figure 4:
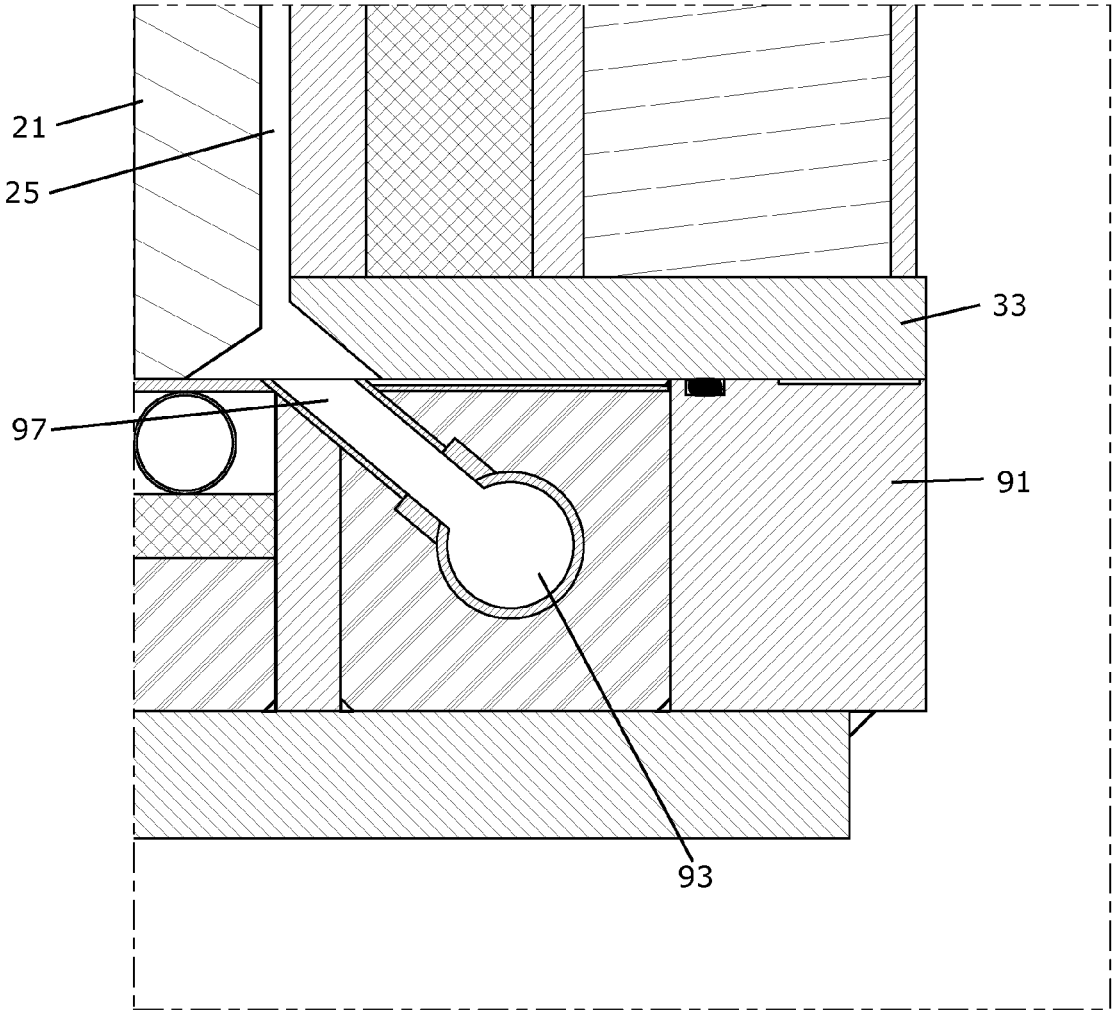
FIG. 4 is a partial sectional view of a bottom portion of a first alternative transfer cask.

FIGS. 3 and 4 illustrate another alternative embodiment of the bottom lid 91 and an integrated ventilation channel. In this embodiment, the ventilation channel is a toroidal-shaped distribution channel 93 having a single channel inlet 95 and a plurality of channel outlets 97 which are positioned to fluidically connect the annulus, formed between the inner shell of the transfer cask and the canister placed in the cavity, with the exterior of the bottom lid 91 and the transfer cask. The radial position of the channel inlet 95 is different than the radial position of the channel outlets 97 so that the configuration of the ventilation channel 93 precludes a direct line of travel from within the cavity to the exterior of the bottom lid.

A transfer cask which includes the annulus between the inner shell and the canister, the ventilation channels in the top flange, and the ventilation channels in the bottom flange, configured in any of the manners discussed above, when out of a storage pool allows ambient air to ventilate up the annulus to enhance the heat removal efficacy of the cask. Calculations have shown that a mere ¾ inch wide annulus can reduce the fuel cladding temperature by as much as an additional 20° C., in comparison to a blind annulus with stagnant air (which is the state-of-the-art). And, as compared to a water cooled annulus, a passive ambient air-cooled annulus is much simpler, easier to use, and easier to maintain, thereby resulting in greater operational reliability.

Such a transfer cask will remove decay heat from the canister by ventilation action. For low heat canisters (those generating less than about 18 kW), the natural ventilation through the annulus coupled with heat dissipation from the external surfaces of the cask are sufficient to keep the contents of the canister from overheating.

Figure 6:
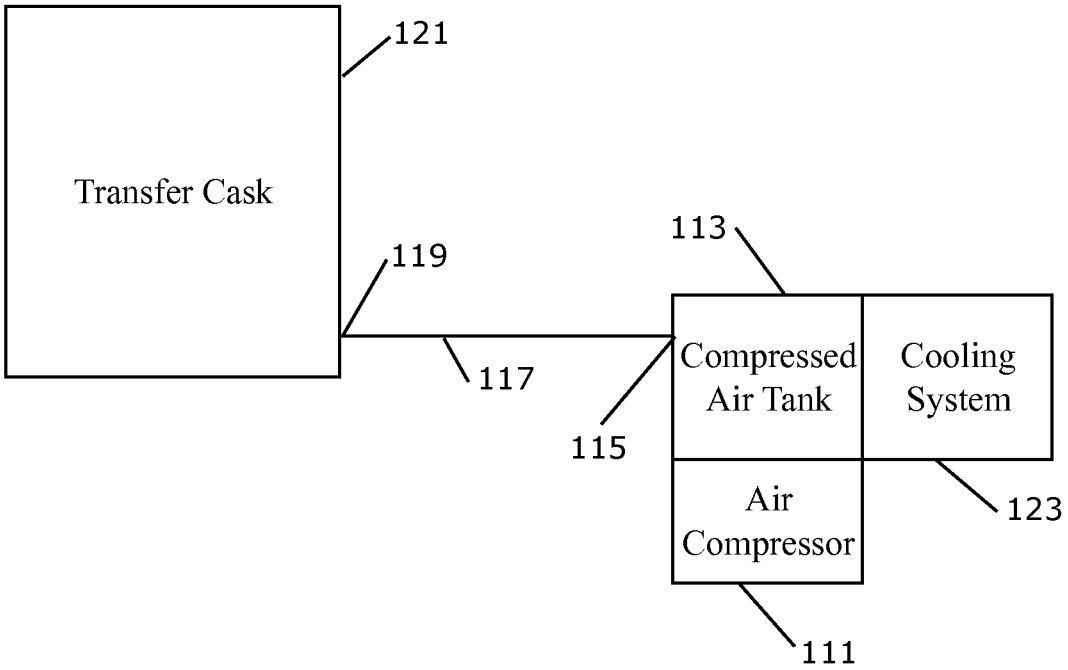
FIG. 6 schematically shows a transfer tank coupled to a forced air cooling system.

In circumstances where additional cooling is needed for higher heat load canisters, beyond the cooling that can be provided by ventilation of ambient air, chilled an can be forced through the annulus. One such system is shown schematically in FIG. 6. And, even a forced air system is simpler and easier to use and maintain than a cooled water system. A forced air system is most easily used when the bottom lid includes an integrated ventilation channel with a single channel inlet, such as is shown in FIG. 3. During use, an air compressor 111 operates to store compressed air in a compressed air tank 113, and the air outlet 115 of the compressed air tank 113 is fluidically coupled though an appropriate air line 117 to the channel inlet 119 of the bottom lid of the transfer cask 121. The compressed air tank 113 itself may be cooled by ambient air, or it may be cooled by an active cooling or refrigeration system 123. As those of skill in the an will recognize, decompression of air naturally decreases the temperature of that air, so that the amount of cooling needed for the compressed air tank 113 will depend upon the heat dissipation needs of the transfer cask. For example, a refrigeration system may be used to cool the compressed air tank to a temperature as low as 5° C., thereby causing the decompressed air from the compressed air tank to be cooler still when it is directed into the annulus of the transfer cask. The decompressed air is delivered into the ventilation channel of the bottom lid, and then into the annulus, by the positive pressure of expansion upon release, from the compressed air tank.

The air compressor and compressed air tank are sized to provide the cooled air at a sufficiently high velocity to ensure turbulent flow conditions within the annulus. Calculations have shown that a 50 HP compressor is adequate to cool a canister with as much as 35 kW heat load. The chilled air is heated within the annulus and exits the transfer cask through the ventilation channels in the to flange.

As an alternative to using a compressed air tank and an air compressor, chilled air may alternatively be forced into the annulus by use of a blower.

Figure 7:
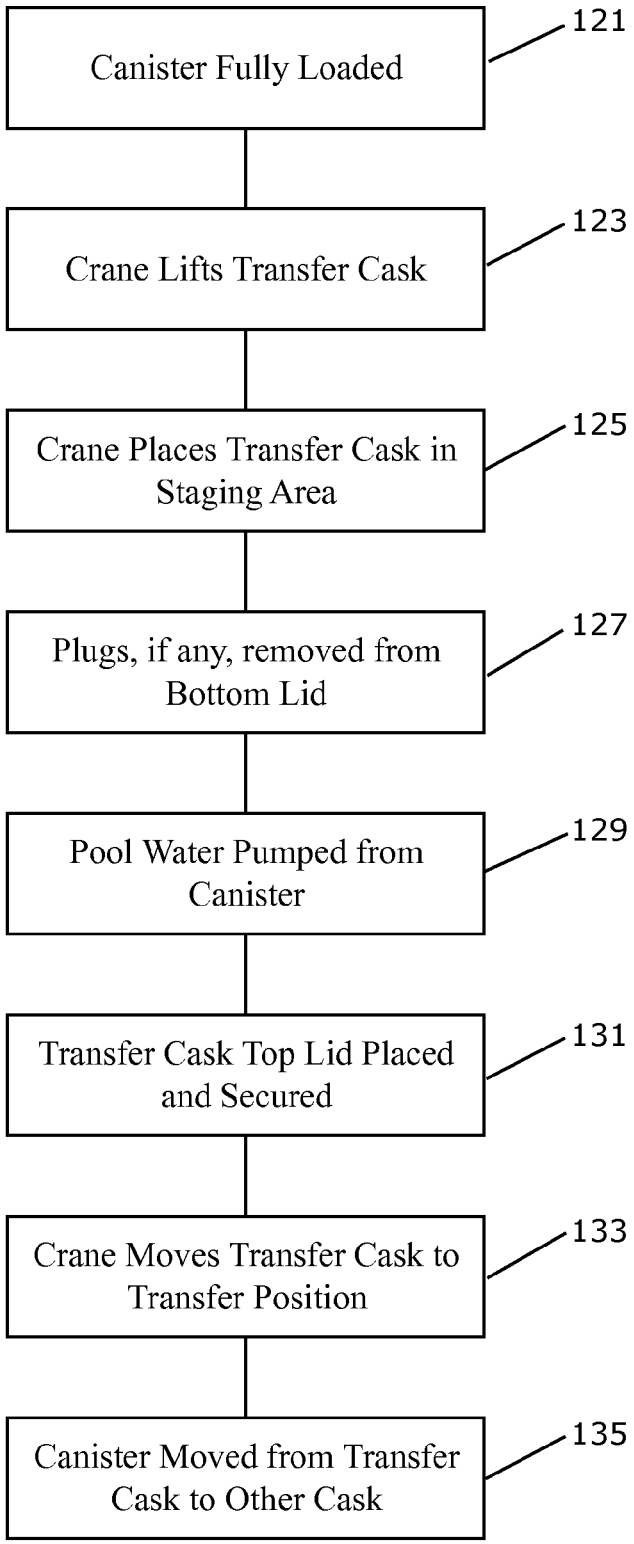
FIG. 7 is a flow chart showing a process for moving a transfer cask loaded with a canister containing spent nuclear fuel out of a storage pool.

The advantages of a forced air cooling system include greater simplicity, as compared to a water cooled system, use of single phase cooling medium (air rather than water) and mitigation of the concerns of leakage (no water spillage) at the flanged or screwed joints. The performance of the system is easily monitored by measuring the temperature of the exiting heated air from the cask FIG. 7 is a flowchart showing the process of moving a transfer cask, as described above with ventilation channels, loaded with a canister from a pool for transport or storage of the canister.

The process starts 121 with a fully loaded canister in the cavity of transfer cask without the top lid in place. The process of loading the canister is well-known to those of skill in the art, and so they are not discussed herein. As the transfer cask sits in the pool, one or more plugs may be in place in the bottom lid to seal of the ventilation channels to make the ventilation channels and the annulus a "blind" cavity, thereby protecting from ingress of contaminated water. Without the plugs in place, water fills the annulus and helps to remove heat generated by the spent nuclear fuel in the canister.

The hoist of a crane is lowered into the pool and secured to the trunnions of the transfer cask. Once the hoist is secured to the trunnions, the crane lifts 123 the transfer cask, along with the canister payload, out of the storage pool. The transfer cask is designed so that at this stage in the process, the combined weight of the transfer cask and payload is equal to or less than the rated lifting capacity of the crane.

Once lifted out of the storage pool, the crane sets transfer cask down 125 in a staging area. At this point, the canister contains pool water in addition to the spent nuclear fuel. This pool water acts as a neutron absorber as long as it is in the canister, and it removed from the canister in order to store the spent nuclear fuel in a dry-state. In the event that one or more plugs are in place in the bottom lid, they are removed 127 to allow ventilated cooling by circulation of atmospheric air through the annulus.

As an alternative, at this point, a compressed air tank is fluidically coupled to the channel inlet of the bottom lid using an appropriate hose and coupling. The compressed air tank is coupled to an air compressor so that compressed air is maintained in the tank during use. Compressed air from the tank is decompressed and passed into the channel inlet during the remaining steps of moving the transfer cask while it is loaded with the canister.

Once the transfer cask is ventilated, the pool water in the canister is pumped out 129, and the spent nuclear fuel in the canister is allowed to dry. The canister is then backfilled with an inert gas, such as helium, and sealed. The cask lid is then secured 131 to transfer cask. The transfer cask is then lifted by the crane and moved to a position above another cask 133, at which point the bottom lid is removed and the canister is lowered into the other cask 135. The other cask may be a storage cask, if the spent nuclear fuel is to be stored long-term, or it may be a transport cask suitable for moving spent nuclear fuel over long distances.

Once the canister is removed from the transfer cask, the transfer cask may be reused to perform the above described procedure again. To reuse the transfer cask, the one or more plugs are again put in place in the bottom lid to seal oft the ventilation channels.

While the invention has been described with respect to specific examples including presently preferred modes of caring out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An apparatus for transferring spent nuclear fuel, the apparatus comprising:

a cylindrical inner shell forming a cavity configured to receive a canister containing spent nuclear fuel, the cavity configured so that an annulus is formed between a canister placed in the cavity and an inner wall of the cylindrical inner shell;

an intermediate shell disposed concentrically around and spaced apart from the inner shell;

an outer shell disposed concentrically around and spaced apart from the intermediate shell;

a bottom flange affixed to bottoms of each of the shells;

a bottom lid removably affixed to the bottom flange and including at least one first channel fluidically connecting the annulus to an exterior of the bottom lid, wherein the at least one first channel is configured to preclude a direct line of travel from within the cavity to the exterior of the bottom lid, and wherein the at least one first channel comprises a toroidal-shaped distribution channel;

a top flange affixed to tops of each of the shells and including at least one second channel fluidically connecting the first annulus to an exterior of the top flange, wherein the at least one second channel is configured to preclude a direct line of travel from within the cavity to the exterior of the top flange; and a top lid removably affixed to the top flange.

2. The apparatus of claim 1, wherein the toroidal-shaped distribution channel includes a plurality of distribution outlets fluidically connecting to the annulus and at least one distribution inlet fluidically connecting to the exterior of the bottom lid.

3. The apparatus of claim 2, further comprising a compressed air tank having an air outlet fluidically coupled to the distribution inlet.

4. The apparatus of claim 3, further comprising a cooling system configured to cool air within the compressed air tank.

5. The apparatus of claim 1, wherein the at least one first channel comprises a plurality of channel inlets distributed approximately equidistantly around the bottom lid.

6. The apparatus of claim 1, wherein an axial length of each of the shells is approximately the same.

7. The apparatus of claim 1, wherein a neutron absorber is disposed in a space formed between the intermediate shell and the outer shell.

8. The apparatus of claim 1, wherein a lead annulus is disposed in a space formed between the intermediate shell and the inner shell.

9. The apparatus of claim 1, the top flange comprising at least two integrally formed trunnions configured to enable hoisting of the apparatus, each trunnion disposed within a recess of the top flange.

10. The apparatus of claim 1, wherein the bottom lid further comprises an impact zone comprising an impact absorbing structure.

11. The apparatus of claim 10, wherein the impact absorbing structure comprises a plurality of tubes distributed throughout the impact zone, the tubes having longitudinal axes aligned with a major dimension of the bottom lid.

12. The apparatus of claim 10, wherein the bottom lid further comprises an impact zone comprising an impact absorbing structure.

13. The apparatus of claim 10, wherein the impact zone extends substantially under an entirety of the cavity.

14. An apparatus for transferring spent nuclear fuel, the apparatus comprising:

a cylindrical inner shell forming a cavity configured to receive a canister containing spent nuclear fuel, the cavity configured so that an annulus is formed between a canister placed in the cavity and an inner wall of the cylindrical inner shell;

an intermediate shell disposed concentrically around and spaced apart from the inner shell;

an outer shell disposed concentrically around and spaced apart from the intermediate shell;

a bottom flange affixed to bottoms of each of the shells;

a bottom lid removably affixed to the bottom flange and including at least one first channel fluidically connecting the annulus to an exterior of the bottom lid, wherein the at least one first channel is configured to preclude a direct line of travel from within the cavity to the exterior of the bottom lid, and wherein the at least one first channel comprises a toroidal-shaped distribution channel;

a top flange affixed to tops of each of the shells, the top flange including at least two integrally formed trunnions configured to enable hoisting of the apparatus, each trunnion disposed within a recess of the top flange; and the top flange including and including at least one second channel fluidically connecting the first annulus to an exterior of the top flange, wherein the at least one second channel is configured to preclude a direct line of travel from within the cavity to the exterior of the top flange; and a top lid removably affixed to the top flange.

15. The apparatus of claim 14, wherein the trunnions are distributed approximately equidistantly around the top flange.

16. The apparatus of claim 14, wherein top flange has a smaller outer diameter as compared to the outer shell.

17. An apparatus for transferring spent nuclear fuel, the apparatus comprising:

a cylindrical inner shell forming a cavity configured to receive a canister containing spent nuclear fuel, the cavity configured so that an annulus is formed between a canister placed in the cavity and an inner wall of the cylindrical inner shell;

an intermediate shell disposed concentrically around and spaced apart from the inner shell;

an outer shell disposed concentrically around and spaced apart from the intermediate shell;

a bottom flange affixed to bottoms of each of the shells;

a bottom lid removably affixed to the bottom flange, the bottom lid including an impact zone comprising an impact absorbing structure, wherein the impact zone extends substantially under an entirety of the cavity;

the bottom lid including at least one first channel fluidically connecting the annulus to an exterior of the bottom lid, wherein the at least one first channel is configured to preclude a direct line of travel from within the cavity to the exterior of the bottom lid, and wherein the at least one first channel comprises a toroidal-shaped distribution channel;

a top flange affixed to tops of each of the shells and including at least one second channel fluidically connecting the first annulus to an exterior of the top flange, wherein the at least one second channel is configured to preclude a direct line of travel from within the cavity to the exterior of the top flange; and a top lid removably affixed to the top flange.

18. The apparatus of claim 17, wherein the impact absorbing structure comprises a plurality of tubes distributed throughout the impact zone, the tubes having longitudinal axes aligned with a major dimension of the bottom lid.

19. The apparatus of claim 18, wherein each of the plurality of tubes is a cylindrical tube.

20. The apparatus of claim 17, wherein the bottom lid further comprises a neutron absorber, and the impact zone is disposed between the neutron absorber and the cavity.

* * * * *